US006176481B1

(12) United States Patent
Ohkoda

(10) Patent No.: US 6,176,481 B1
(45) Date of Patent: Jan. 23, 2001

(54) APPARATUS HAVING CONVEYING MEANS OF MEDIUM

(75) Inventor: Keiji Ohkoda, Yokohama (JP)

(73) Assignee: Canon Kabushiki Kaisha, Tokyo (JP)

( * ) Notice: Under 35 U.S.C. 154(b), the term of this patent shall be extended for 0 days.

(21) Appl. No.: 09/082,300

(22) Filed: May 20, 1998

(30) Foreign Application Priority Data

May 21, 1997 (JP) ..... 9-131293
Jul. 23, 1997 (JP) ..... 9-197159

(51) Int. Cl.[7] ..... B65H 3/44; B65H 3/12; B65H 7/08; B65H 3/64

(52) U.S. Cl. ..... 271/9.05; 271/9.06; 271/9.11; 271/95; 271/111; 271/112

(58) Field of Search ..... 271/9.01, 9.05, 271/9.06, 9.11, 95, 111, 112, 119, 259

(56) References Cited

U.S. PATENT DOCUMENTS

| | | | | |
|---|---|---|---|---|
| 3,150,263 | * | 9/1964 | Catlin | 250/66 X |
| 3,920,238 | | 11/1975 | Kitajima et al. . | |
| 4,313,124 | | 1/1982 | Hara . | |
| 4,345,262 | | 8/1982 | Shirato et al. . | |
| 4,459,600 | | 7/1984 | Sato et al. . | |
| 4,463,359 | | 7/1984 | Ayata et al. . | |
| 4,558,333 | | 12/1985 | Sugitani et al. . | |
| 4,608,577 | | 8/1986 | Hori . | |
| 4,723,129 | | 2/1988 | Endo et al. . | |
| 4,740,796 | | 4/1988 | Endo et al. . | |
| 4,763,889 | | 8/1988 | Dei et al. . | |
| 5,193,794 | | 3/1993 | Steinhilber . | |
| 5,294,101 | * | 3/1994 | Scheufler | 271/9 |

FOREIGN PATENT DOCUMENTS

| | | | | |
|---|---|---|---|---|
| 0 310 060 | | 4/1989 | (EP) . | |
| 0 398 659 | | 11/1990 | (EP) . | |
| 2114103 | * | 8/1983 | (GB) | 271/112 |
| 54-056847 | | 5/1979 | (JP) . | |
| 131647 | * | 8/1982 | (JP) | 217/112 |
| 59-123670 | | 7/1984 | (JP) . | |
| 59-138461 | | 8/1984 | (JP) . | |
| 60-071260 | | 4/1985 | (JP) . | |
| 1-264879 | | 10/1989 | (JP) . | |
| 225227 | * | 9/1990 | (JP) | 271/112 |

* cited by examiner

*Primary Examiner*—Christopher P. Ellis
*Assistant Examiner*—Kenneth W. Bower
(74) *Attorney, Agent, or Firm*—Fitzpatrick, Cella, Harper & Scinto

(57) ABSTRACT

An apparatus has a paper cassette capable of accommodating a recording medium such as large-size recording sheets or OHP film, and an accommodating unit capable of accommodating recording sheets such as plain paper. The types of recording sheets that are accommodated in the paper cassette and accommodating unit are sensed by paper sensors. If the recording sheets accommodated in the paper cassette are large in size or consist of resin film, then one of these recording sheets is attracted by suction using a suction cup and is thus fed from the paper cassette. If the recording sheets accommodated in the accommodating unit are plain paper, one of these recording sheets is extracted from the accommodating unit by a rotating separation roller. The paper cassette and the accommodating unit are respectively provided with a feed unit relying upon the suction cup and a feed unit relying upon the separation roller.

34 Claims, 12 Drawing Sheets

APPARATUS HAVING CONVEYING MEANS OF MEDIUM

BACKGROUND OF THE INVENTION

This invention relates to, for example, a recording apparatus having a conveying means of a recording medium for transporting the recording medium and recording an image on the recording medium, as well as to a method of transporting sheets of the recording medium in this apparatus. In the embodiments set forth below, a case is described in which the recording apparatus is an ink-jet recording apparatus. However, the invention is applicable also to a recording apparatus using various recording techniques, examples of which are thermal printers, photosensitive printers and laser printers.

A variety of recording media can be used in conventional ink-jet printers. Examples are plain paper, glossy paper, transparent sheets for overhead projectors (OHP), postcards, envelopes and seals. In order to use these recording media selectively, the conventional practice is to provide the apparatus with a feed port for manual insertion of sheets and to accommodate the sheets that are usually used in a paper cassette. Sheets that are used only on a temporary basis are manually inserted from the feed port one sheet at a time. This arrangement has a number of drawbacks.

Specifically, only a single mechanism is provided for stacking and accommodating a plurality of sheets of the recording medium and extracting the stacked recording medium one sheet at a time. As a consequence, if two types of recording media are often used and these two types of recording media are used by frequently switching between them, one type must always be inserted manually one sheet at a time.

In recent years, large numbers of printers of a type capable of handling recording media in the form of large-size sheets have appeared. For example, printers capable of printing on recording sheets of sizes A3 and A2, etc., have become quite common. At the same time, higher definition obtained by raising the recorded pixel density has been accompanied by improved recorded image quality, and this has made possible the widespread use of glossy paper and transparent sheets for the recording of photographic images. These sheets consist of a base material and an ink-absorbing image-receiving layer formed on the base material, and the sheet surface is formed to be much smoother than that of plain paper. When a plurality of such sheets are stacked, therefore, adjacent sheets are more likely to adhere to each other. If a resin material such as a PET (polyethylene terephthalate) film is used as the base material of these sheets, static electricity tends to be produced, causing the sheets to exhibit even greater adhesion to each other. Moreover, the image-receiving layer itself has a greater viscosity than plain paper. Owing to the greater size and higher mutual adhesion of these sheets, it is extremely difficult to feed them stably using the conventional technique in which sheets are separated and fed one at a time by means of a separating roller. Accordingly, the state of the art is such that when recording is performed on sheets of this type, the sheets are set by inserting them manually one at a time. When recording is to be performed on large quantities of such sheets, the operation cannot be performed in an efficient manner.

SUMMARY OF THE INVENTION

Accordingly, an object of the present invention is to provide an apparatus through which even sheets of a medium exhibiting a high adhesion can be separated, fed and recorded on one sheet at a time in reliable fashion.

Another object of the present invention is to provide a recording apparatus wherein an ordinary medium and a special medium exhibiting a high adhesion can be accommodated in the recording apparatus and recorded on while being selectively fed in reliable fashion.

Another object of the present invention is to provide an apparatus wherein an ordinary medium and a special medium exhibiting a high adhesion can be accommodated in the apparatus and selectively fed in reliable fashion.

Another object of the present invention is to provide an apparatus capable of selecting a specified medium automatically and of recording an image on the selected recording medium in reliable fashion.

A further object of the present invention is to provide a recording apparatus in which a plurality of recording-medium accommodating units are provided and a specified recording medium can be selected and recorded on.

A further object of the present invention is to provide an apparatus in which a plurality of recording medium accommodating units are provided and a specified medium can be selected.

Yet another object of the present invention is to provide a recording apparatus for sensing the type of recording medium accommodated in each of a plurality of recording-medium accommodating units and, if the sensed type of recording medium is suited to means for feeding the recording medium from the accommodating unit, feeding and recording on the recording medium.

Other features and advantages of the present invention will be apparent from the following description taken in conjunction with the accompanying drawings, in which like reference characters designate the same or similar parts throughout the figures thereof.

BRIEF DESCRIPTION OF THE DRAWINGS

The accompanying drawings, which are incorporated in and constitute a part of the specification, illustrate embodiments of the invention and, together with the descriptions, serve to explain the principle of the invention.

DESCRIPTION OF THE PREFERRED EMBODIMENTS

Preferred embodiments of the present invention will now be described in detail with reference to the accompanying drawings.

Figure 1:
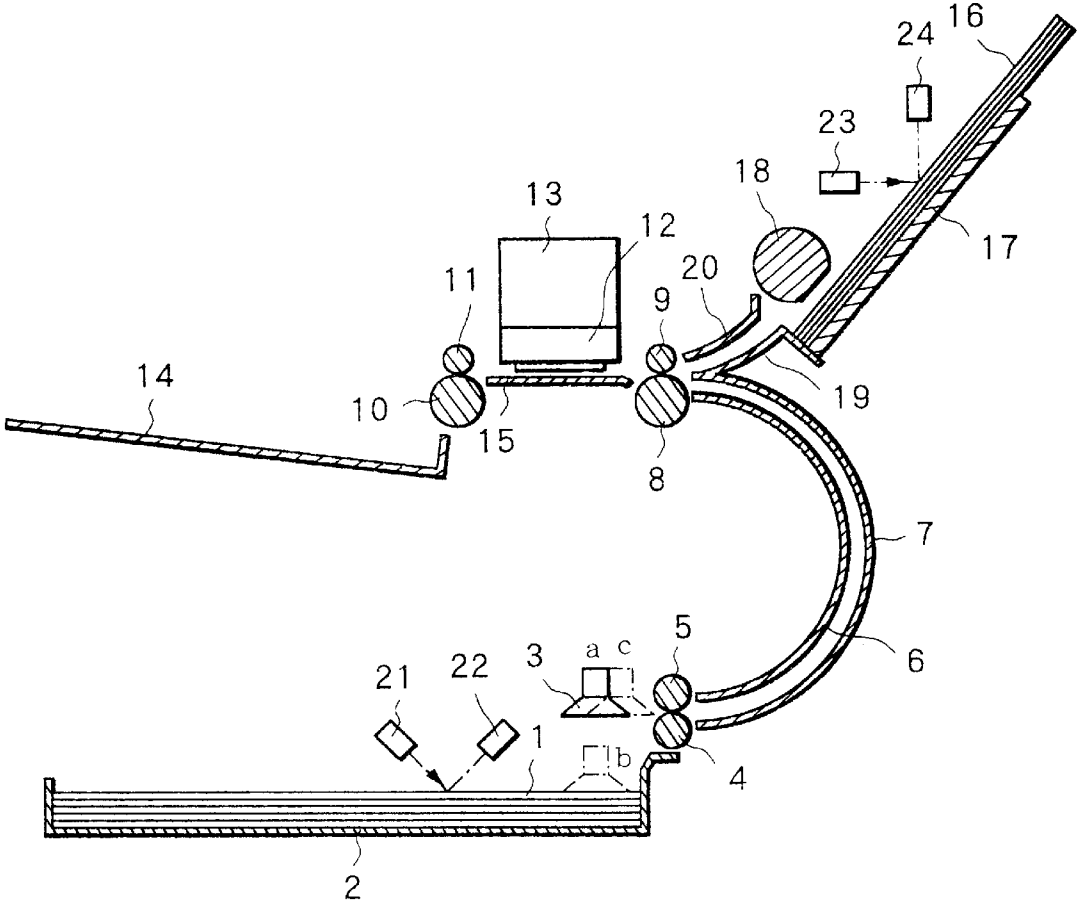
FIG. 1 is a sectional view for describing the transport path of recording paper in an ink-jet recording apparatus according to a first embodiment of the present invention.

FIG. 1 is a sectional view illustrating the structure of a recording paper transport mechanism in an ink-jet recording apparatus according to a first embodiment of the present invention. Though a recording medium is described as being recording paper in the following embodiment, the recording medium is not limited to ordinary recording paper but is assumed to include various sheet-like media such as resin sheets for OHP and sheets that have been subjected to special coating treatments.

As shown in FIG. 1, sheets of unused stacked first recording paper 1 are placed in a supply tray (paper cassette) 2 in substantially horizontal fashion. A suction cup 3 is moved by a suction-cup moving mechanism (108 in FIG. 4), described later, from a position a in FIG. 1 to a position b at which it contacts the uppermost sheet of the unused first recording paper 1 stacked in the tray, thereby making it possible for the suction cup 3 to suck and lift the uppermost sheet. At this time a suction mechanism (109 in FIG. 4), described later, reduces the pressure inside the suction cup 3 contacting the recording paper, thereby causing the uppermost sheet of the recording paper 1 to be attracted to the suction cup so that the uppermost sheet is separated from the remaining sheets of recording paper. Under these conditions the suction cup 3 is moved by the suction-cup moving mechanism 108 to a position c at which the leading edge of the separated sheet can be inserted between transport rollers 4, 5. The suction operation of the suction mechanism 109 is then halted to release the suction force of the suction cup 3, whereby the suction cup 3 releases its hold on the recording paper.

Figure 4:
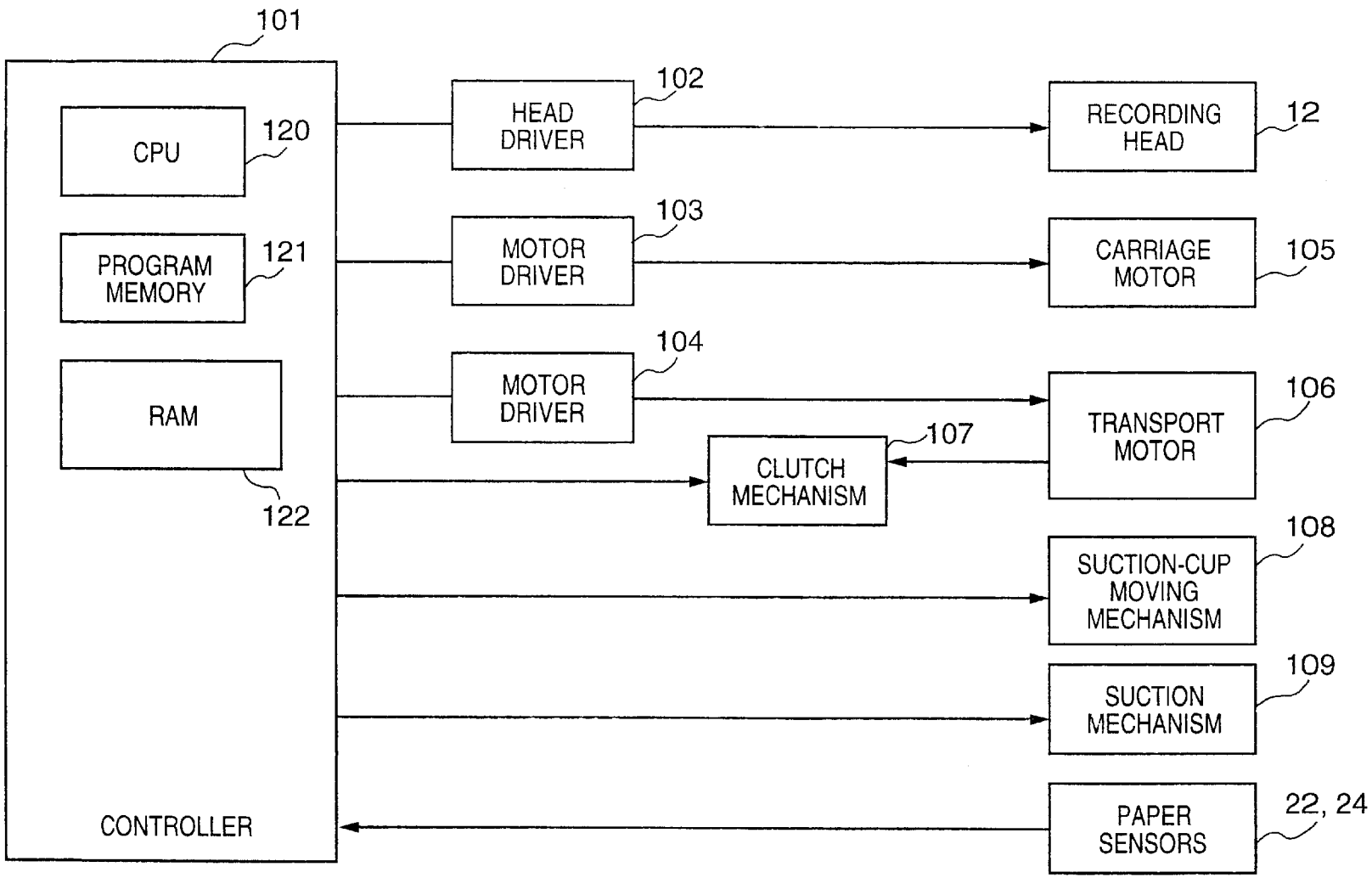
FIG. 4 is a block diagram illustrating the construction of the control circuitry of an ink-jet recording apparatus according to an embodiment of the present invention.

The transport rollers 4, 5 are rotated by a driving source such as a transport motor (106 in FIG. 4) via a clutch mechanism (107 in FIG. 4). Guide plates 6, 7 are arranged to oppose each other across a prescribed gap and form a first supply path for the recording paper transported by the rotation of the transport rollers 4, 5. The supply path formed by the guide plates 6, 7 has a generally semicircular (curved) cross section and extends from the vicinity of the transport rollers 4, 5 to first sub-scan rollers 8, 9 located above the transport rollers 4, 5. The sub-scan rollers 8, 9, together with second sub-scan rollers 10, 11 arranged in parallel with the sub-scan rollers 8, 9 on the left side thereof, grasp the transported sheet of recording paper and feed the paper under the control of a controller (101 in FIG. 4), described later. A guide plate 15 regulates the position of the recording paper between the first sub-scan rollers 8, 9 and the second sub-scan rollers 10, 11. A recording head (ink-jet recording head) 12 has a plurality of ink jetting nozzles arranged along the direction in which the recording paper 1 is transported. A plurality of ink-jet heads, each for jetting a different color, may be provided instead of the single head 12. An ink tank 13 contains ink supplied to the recording head 12. The recording head 12 and ink tank 13 are carried on the same carriage (not shown) and are held movably in a direction (the vertical direction in FIG. 1) perpendicular to the transport direction of the recording paper by a carriage guide (not shown) disposed substantially in parallel with the rotary shafts of the sub-scan rollers 8, 9, 10, 11 of FIG. 1. A receiving tray 14 receives the recording paper discharged from between the sub-scan rollers 10, 11 after the paper has been recorded on.

Sheets of unused stacked second recording paper 16 are placed in an upper recording paper accommodating unit. A pressure plate 17 supports the stacked and accommodated recording paper 16 and urges the paper in the direction of a separating roller 18. Guide plates 19, 20 form a second supply path for introducing the leading edge of one sheet of the recording paper, which has been extracted from the separating roller 18, to the sub-scan rollers 8, 9.

Means 21, 22, 23, 24, disclosed, for example, in the specification of Japanese Patent Application Laid-Open (KOKAI) No. 1-264879, sense whether or not sheets of the recording paper 1, 16 are present or not as well as the quality of the paper. Specifically, light sources 21, 23 illuminate the surfaces of the recording paper 1, 16 with light of a predetermined wavelength, respectively. The light is reflected from the recording paper surfaces. Light sensors 22, 24 receive the reflected light, respectively.

Sensing of paper quality using such reflection of light is based upon the fact that surface roughness depends upon the type of recording paper and causes a difference in the extent to which the light is scattered. For example, when viewed microscopically, the surface of plain paper is seen to be composed of interwoven fibers. Such a surface produces much scattering and results in small output signals from the sensors 22, 24. On the other hand, a sheet of paper having a smooth surface that causes little scattering of light results in large output signals from the sensors 22, 24. Using such light sensing means makes it possible to determine whether recording paper corresponding to the first separating mechanism relying upon the suction cup 3 or to the second separating mechanism employing the separating roller 18 has been loaded in the corresponding cassette or whether recording paper suitable for recording has been installed.

Figure 2:
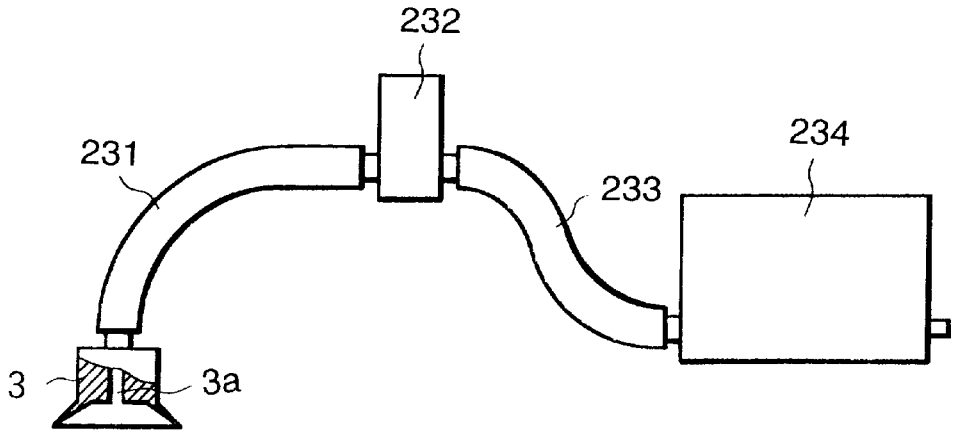
FIG. 2 is a diagram for describing a suction function according to this embodiment.

FIG. 2 is a diagram showing an example of the suction mechanism for the suction cup 3.

Figure 3:
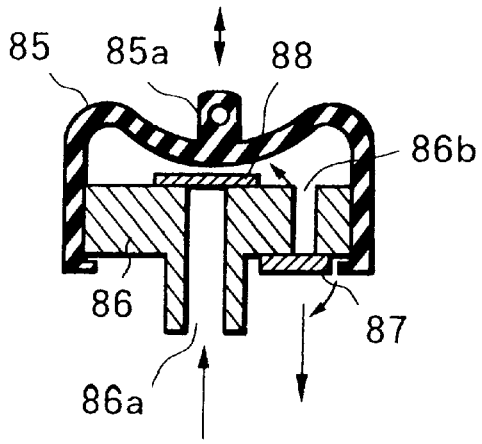
FIG. 3 is a diagram useful in describing a diaphragm in a solenoid pump according to this embodiment.

As shown in FIG. 2, the suction cup 3 has a hole 3*a* for producing suction. The hole 3*a* is connected to a hose 231 whose other end is connected to a solenoid valve 232. The other side of the solenoid valve 232 is connected to a solenoid pump 234 via a hose 233. A rubber diaphragm 85 shown in FIG. 3 is provided within the solenoid pump 234. The diaphragm 85 has a central portion 85*a* repeatedly pushed and pulled at high speed by electromagnetic force generating means, not shown. The diaphragm 85 is fitted onto a base 86 provided with a suction port 86*a*, a discharge port 86*b* and unidirectional valves 87, 88. The hose 233 is connected to the suction port 86*a* of the diaphragm 85 within the solenoid pump 234. Owing to the push-pull operation of the diaphragm 85, therefore, air drawn in from the suction port 86*a* is discharged from the discharge port 86*b*, thus making it possible to lower the pressure of the portion connected to the suction port 86*a*.

When a sheet of recording paper is to be attracted to the suction cup 3 by this arrangement, the suction cup 3 is pressed against the recording paper, the solenoid valve 232 is closed and the solenoid pump 234 is activated. The solenoid pump 234 is driven continuously during the attraction of the recording paper. When sucking by the suction cup 3 is to be halted, the solenoid valve 232 is opened and the solenoid pump 234 is stopped. The reason for using the solenoid valve 232 is to enable external air to be drawn in rapidly and to allow sucking by the suction cup 3 to be terminated immediately. If it were attempted to terminate the sucking operation merely by stopping the solenoid pump 234 without relying upon the solenoid valve 232, the discharge of air would be too slow and it would take too long to end suction, thereby hindering operation of the apparatus.

It should be noted that the solenoid pump 234 may use various means other than a diaphragm. For example, it is possible to use a vortex pump which discharges air owing to the rotation of an internal impeller.

In the suction-cup moving mechanism 108, a mechanism for moving upwards and downwards the suction cup 3 includes a rocking arm driven by a motor, and a mechanism for laterally conveying the suction cup 3 slidably supports the suction cup 3 along the rocking arm. The suction cup 3 is laterally moved on the rocking arm via a belt driven the motor.

FIG. 4 is a block diagram illustrating the construction of an ink-jet recording apparatus according to this embodiment.

The apparatus shown in FIG. 4 includes the controller 101 for controlling the overall operation of the apparatus. The controller 101 has a CPU 120 of a microcomputer or the like, a program memory 121 and a RAM 122 for temporarily saving various data when processing is executed by the CPU 120. A head driver 102 drives the recording head 12 in accordance with a command from the controller 101 so that recording (printing) may be carried out. Motor drivers 103, 104 rotatively drive a corresponding carriage motor 105 and transport motor 106 in accordance with commands from the controller 101. The carriage motor 105 drives the recording head 12 to transport the same, and the transport motor 106 is capable of rotatively driving the transport rollers 4, 5, 8, 10 and separating roller 18 of FIG. 1 independently via the clutch mechanism 107. The suction-cup moving mechanism 108 moves the suction cup 3 to any of the positions a, b, c in FIG. 1. The suction mechanism 109 discharges air from the suction port of suction cup 3 so that a sheet of recording paper will be attracted to the suction cup 3. Numerals 22 and 24 denote the paper sensors shown in FIG. 1.

The operation of the ink-jet recording apparatus according to this embodiment of the invention constructed as set forth above will now be described.

Described first will be a case where the first recording paper 1 accommodated in the paper cassette 2 at the lower part of the apparatus is selected and recorded upon.

In response to a command for starting recording, the suction-cup moving mechanism 108 moves the suction cup 3 from position a to position b so that the suction cup 3 is made to contact the uppermost sheet of the recording paper 1 stacked in the paper cassette 2. Next, the suction mechanism 109 discharges air from within the suction cup 3 to reduce its internal pressure. As a result, the uppermost sheet of recording paper is attracted to the suction cup 3. The suction-cup moving mechanism 108 then moves the suction cup 3 to the upper position a and thence rightward in FIG. 1 to the position c so that the leading edge of the sheet of recording paper being attracted to the suction cup 3 will be grasped by the transport rollers 4, 5. When the transport rollers 4, 5 are rotated by rotation of the transport motor 106, the recording paper that has been inserted between the transport rollers 4, 5 is caused to advance upward along the first supply path formed by the guide plates 6, 7 so that the leading edge of the paper will be inserted between and grasped by the sub-scan rollers 8, 9.

The sheet of recording paper thus transported is grasped by the sub-scan rollers 8, 9 and is advanced and stopped intermittently. While the recording head 12 is moved in the direction perpendicular to the paper transport direction when the recording paper is at rest, the recording head 12 is driven in conformity with the image data to be recorded. As a result, ink is jetted from the recording head 12 to record the image on the sheet of recording paper. When the leading edge of the recording paper 1 on which the image has thus been recorded reaches the second sub-scan rollers 10, 11, the recording paper 1 is transported while being grasped by the four sub-scan rollers 8, 9, 10, 11. After the trailing edge of the recording paper leaves the first sub-scan rollers 8, 9, the recording paper is transported solely by the rotation of the second sub-scan rollers 10, 11. The sheet of recording paper on which recording has thus been completed is discharged into the receiving tray 14 by further rotation of the second sub-scan rollers 10, 11.

Described next will be a case where the second recording paper 16 placed in the upper paper accommodating unit is selected and recorded upon.

First the pressure plate 17 is moved upward in response to a recording start command to thereby urge the uppermost sheet of the stacked recording paper 16 against the separating roller 18. The latter is rotated in the clockwise direction so that the uppermost sheet of the recording paper can be fed into the second supply path defined by the guide plates 19, 20. The leading edge of the recording paper thus fed is grasped by the sub-scan rollers 8, 9 and transported by the rotation thereof. Operation during the ensuing recording is similar to that in the case where recording is performed on recording paper from the paper cassette 2.

Even if the first recording paper 1 accommodated in the paper cassette 2 is a large-size (A2 or A3, for example) recording medium wherein adjacent sheets are likely to adhere to each other, such as an image-receiving paper having an absorbing layer provided on a white or transparent PET base film, the sheets can be transported reliably one at a time in a state in which a plurality of the sheets are stacked in the cassette 2.

By placing ordinary paper such as plain paper, which is capable of being fed by the separating roller 18, as the second recording medium in the upper accommodating unit, this paper can also be transported automatically one sheet at a time in reliable fashion and recorded upon without being manually inserted sheet by sheet.

In accordance with the ink-jet recording apparatus of the first embodiment, therefore, sheets of different types can be used selectively in efficient fashion and they can be recorded on one at a time in a reliable manner.

Figure 5:
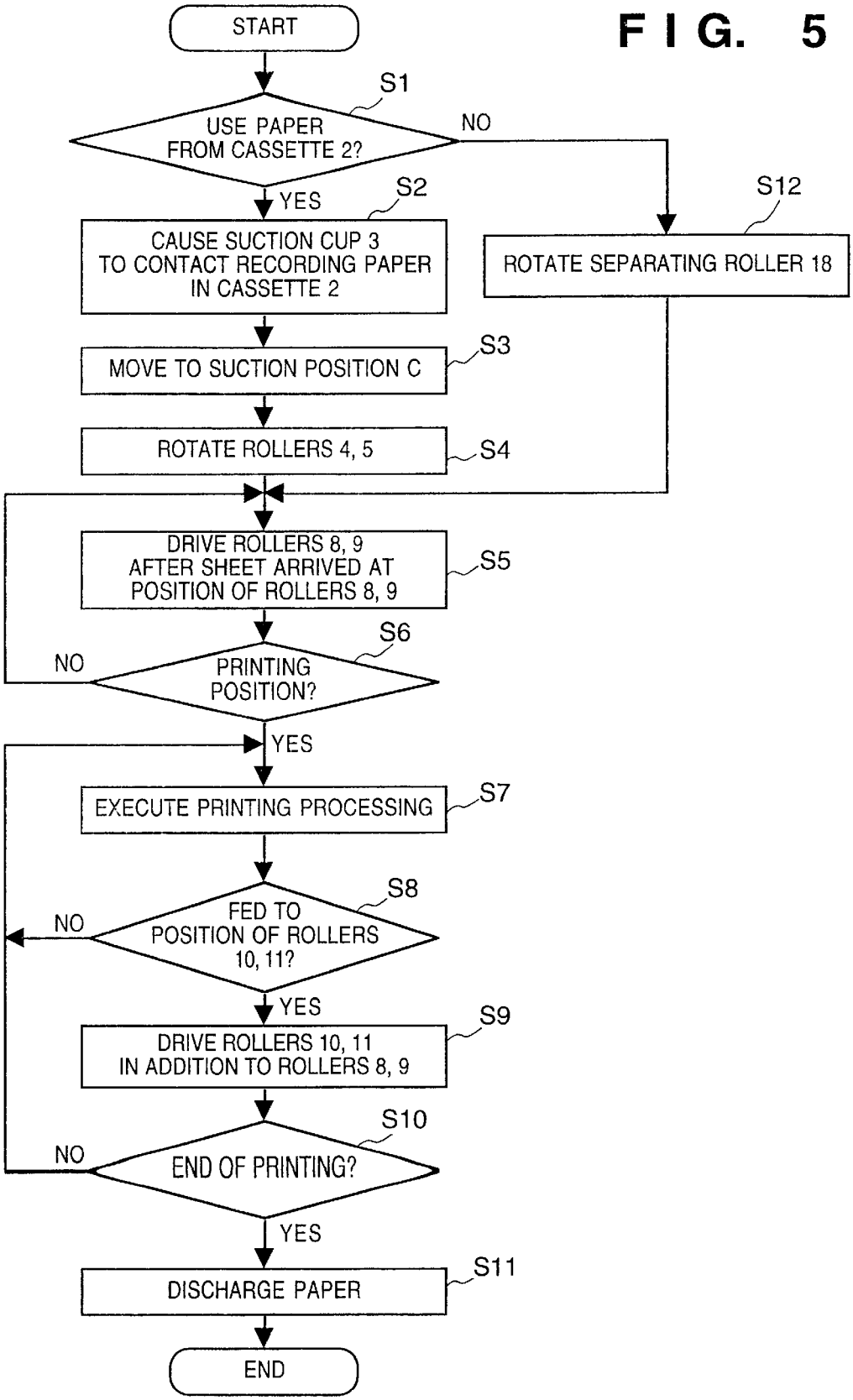
FIG. 5 is a flowchart illustrating recording processing in the ink-jet recording apparatus of this embodiment.

FIG. 5 is a flowchart illustrating recording processing according to the ink-jet recording apparatus of this embodiment. The control program for executing this processing is stored in the program memory 121.

This processing is started in response to a recording processing start command. It is determined at step S1 whether the recording paper (first recording paper) accommodated in the paper cassette 2 or the recording paper (second recording paper) accommodated in the upper accommodating unit is used for recording. When recording processing is performed using the first recording paper, control proceeds to step S2. Here the suction-cup moving mechanism 108 moves the suction cup 3 from position a to position b (see FIG. 1) to attract the uppermost sheet of the recording paper in cassette 2. This is followed by step S3, at which the suction-cup moving mechanism 108 moves the suction cup 3 to position c so that the leading edge of the recording paper is grasped by the transport rollers 4, 5. Control then proceeds to step S4, at which the transport rollers 4, 5 are rotatively driven so that the paper being grasped by the transport rollers 4, 5 is transported along the first supply path.

When the leading edge of the recording paper reaches the position of the sub-scan rollers 8, 9, the rollers 8, 9 are set into rotation at step S5 to move the recording paper to the recording position. It is determined at step S6 whether the recording paper has reached the recording position. If the decision is "YES", then control proceeds to step S7. Here recording processing is executed by driving the recording head 12 in dependence upon the image data to be recorded, this being carried out while the recording head 12 is scanned by the carriage motor 105. When it is found at step S8 that the leading edge of the recording paper has reached the position of the sub-scan rollers 10, 11, control proceeds to step S9. Here the sub-scan rollers 10, 11 are rotatively driven in addition to the rollers 8, 9. When recording equivalent to one scan by the recording head 12 is finished, the recording head 12 is returned to the home position (i.e., a carriage return operation is performed), the sub-scan rollers 8, 9, 10, 11 are rotated, a predetermined amount of recording paper is transported in dependence upon recording width and the above-described recording processing is executed. These processing steps are repeatedly executed until one page of recording processing is completed. When such is the case, control proceeds to step S11. Here the rollers 10, 11 are rotated further to discharge the sheet of recording paper on which recording has been completed.

If it is determined to record on a recording paper accommodated on the pressure plate 17 at step S1, then control proceeds to step S12, the separating roller 18 is rotated so that the uppermost sheet of the recording paper is fed into the second supply path defined by the guide plate 19, 20. Then control proceeds to step S5, the same operation is performed as described above.

It should be noted that detection of the leading edge of the recording paper at steps S5, S6 and S8 may be performed by a paper sensor, not shown. Alternatively, detection of the leading edge of the recording paper may be performed by a judgment based upon the amount of rotation of the transport rollers 4, 5 and/or 8, 9.

Further, the decision processing at step S1 can be a judgment, based upon signals from the paper sensors 22, 24, as to which of the recording paper accommodating units is accommodating the recording paper of the type to be used in recording. It can be so arranged that the recording paper from the accommodating unit containing recording paper of the type to be used is selected to perform recording. If it is judged that the desired recording paper has not been set in either accommodating unit, an error message may be displayed, for example, or an error message may be sent back to the host device that issued the print command.

Figure 6:
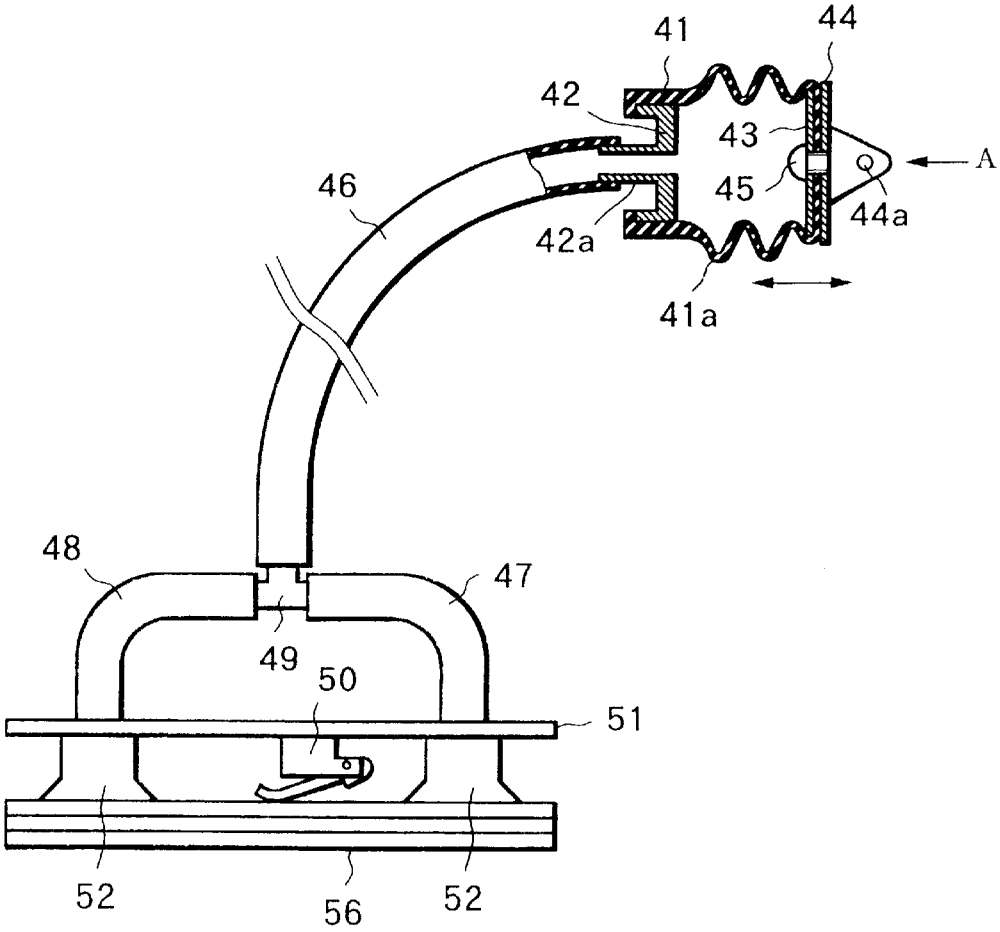
FIG. 6 is a diagram for describing a suction mechanism according to another embodiment of the present invention.

FIG. 6 is a diagram for describing another example of the suction mechanism 109 according to this embodiment.

Figure 7:
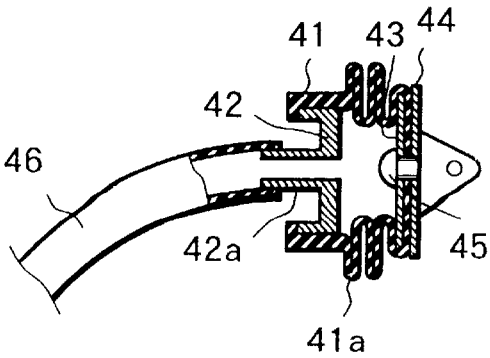
FIG. 7 is a diagram useful in describing the diaphragm of FIG. 6 in the contracted state.

FIG. 6 is a sectional view illustrating a rubber diaphragm 41 having a freely contractible bellows 41*a*. The diaphragm 41 is circular in shape when observed from the direction of arrow A. The diaphragm 41 is attached to a base 42 the central part of which has a pipe portion 42*a* to which a hose 46 is connected. The joint at which the diaphragm 41 and base 42 contact each other is air tight since the inner diameter of the diaphragm 41 is smaller than the outer diameter of the base 42. The base 42 is secured to a frame, which is not shown. A circular plate 43 is disposed on the left side of the end face of diaphragm 41, and a metal fitting 44 having a connecting portion 44*a* for connection to the mechanism that causes the diaphragm 41 to expand and contract is disposed on the right side of the diaphragm end face. The circular plate 43 and metal fitting 44 are fastened together by a screw 45 to clamp the end face of the diaphragm 41 between them. This is to prevent the end face from becoming deformed when the diaphragm 41 is expanded and contracted. The hose 46 is connected to hoses 47, 48 via a coupling pipe 49. Suction cups 52 are provided on the distal ends of the hoses 47, 48. A member 51 is for holding and moving the suction cups 52. An interrupter 50 equipped with an actuator is attached to the member 51. Stacked recording paper is shown at 56. The suction cups 52 are moved toward and away from the recording paper 56 by a moving mechanism, not shown. FIG. 6 illustrates the diaphragm 41 in a state in which the bellows 41*a* thereof has been expanded by the diaphragm contracting and expanding mechanism (not shown). FIG. 7 shows the diaphragm 41 with the bellows 41*a* in the contracted state.

In terms of the operation of this mechanism, the suction cups 52 are made to contact the recording paper 56 in a state in which the bellows 41*a* of the diaphragm 41 is contracted. Next, when the suction cups 52 are flattened by being pressed against the recording paper 56, the interrupter 50 generates a signal. The diaphragm contracting and expanding mechanism (not shown) is triggered by this signal to pull the fitting 44 rightward in FIG. 6. As a result, the bellows 41*a* of the diaphragm 41 is stretched to assume the state shown in FIG. 6, whereby its volume is increased. This causes a decrease in pressure within the bellows 41*a* and causes the suction cups 52 to attract the recording paper 56. By moving the suction cups 52 thus attracting the recording paper 56, only the uppermost sheet of the recording paper is separated from the stack. When the timing for releasing the attracted sheet of recording paper arrives, the metal fitting 44 is biased leftward in FIG. 6 and assumes the state shown in FIG. 7, thereby contracting the diaphragm 41 and causing the suction cups 52 to release their hold on the recording paper.

[Second Embodiment]

A second embodiment of the present invention will be described next.

Figure 8:
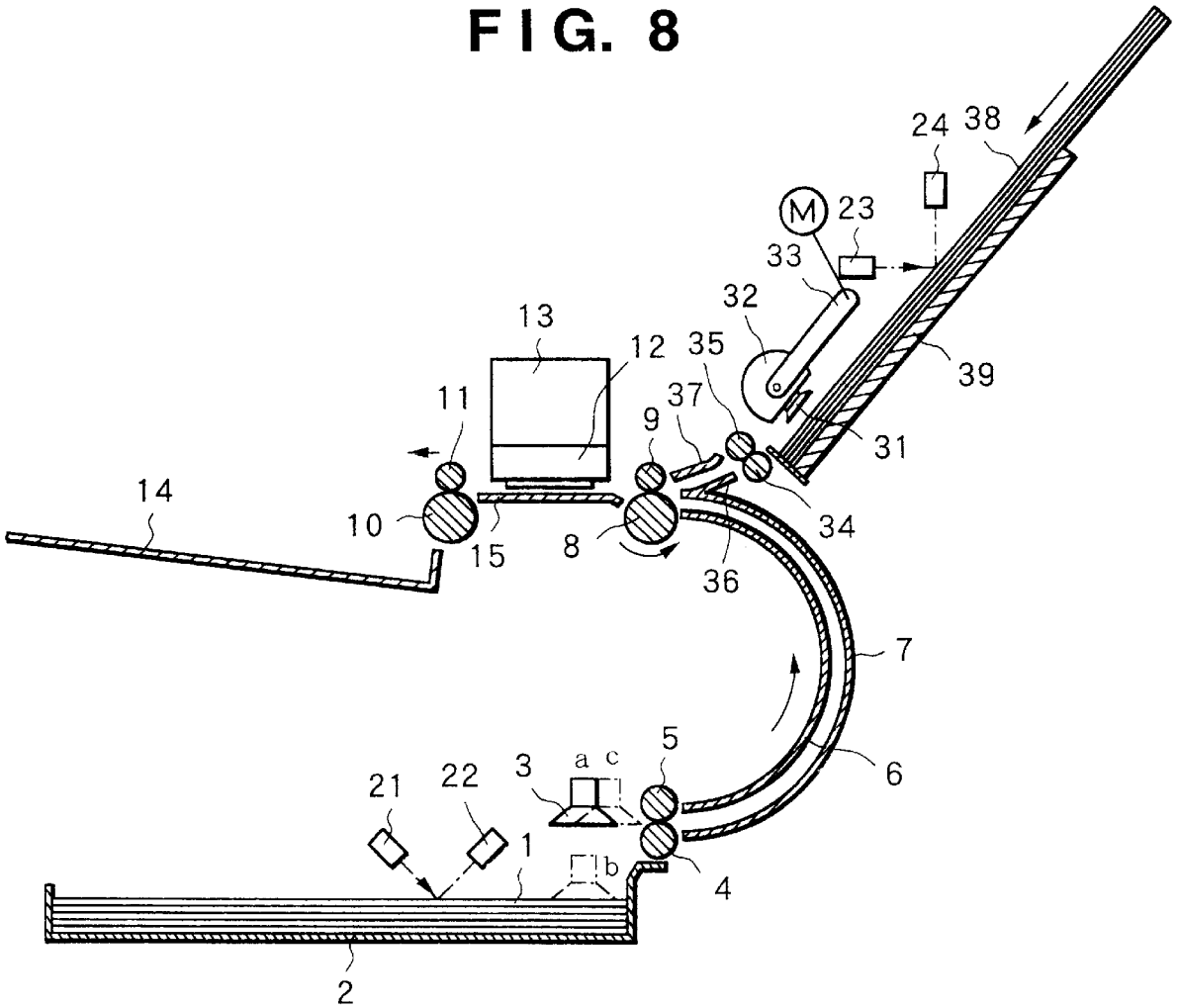
FIG. 8 is a sectional view for describing a sheet transport mechanism in an ink-jet recording apparatus according to a second embodiment of the present invention.

FIG. 8 is a sectional view illustrating the structure of the recording paper transport mechanism in an ink-jet recording apparatus according to a second embodiment of the present invention. Components identical with those shown in FIG. 1 are designated by like reference characters and need not be described again.

The difference between the first and second embodiments is that the mechanism for separating the sheets of a second recording paper 38 has the functions of both a suction cup 31 and a separating roller 32.

As shown in FIG. 8, the separating roller 32 having a cut portion is a component having a function the same as that of the separating roller 18 in FIG. 1. The suction cup 31 is provided on the outer circumference (the cut portion) of the separating roller 32. An arm 33 of a support mechanism holds the separating roller 32 in such a manner that the roller 32 can rotate freely and can be moved over a desired range. The arm 33 is driven by a motor M. Sheets of accommodated, stacked, unused recording paper (second recording paper) are shown at 38. A pressure plate 39 urges the recording paper against the separating roller 32. Transport rollers 34, 35 feed a separated sheet of recording paper to the sub-scan rollers 8, 9. Guide plates 36, 37 form a second supply path extended between the transport rollers 34, 35 and the sub-scan rollers 8, 9. The suction cup 31 is connected to the horse 231 in FIG. 2 via a hollow axis 32*a* (FIG. 10) in the roller 32 so that the separating roller 32 can rotate with the suction cup 31.

Two separating operations described below can be selected automatically in dependence upon the type of recording paper sensed by the paper sensors 23, 24.

Figure 9:
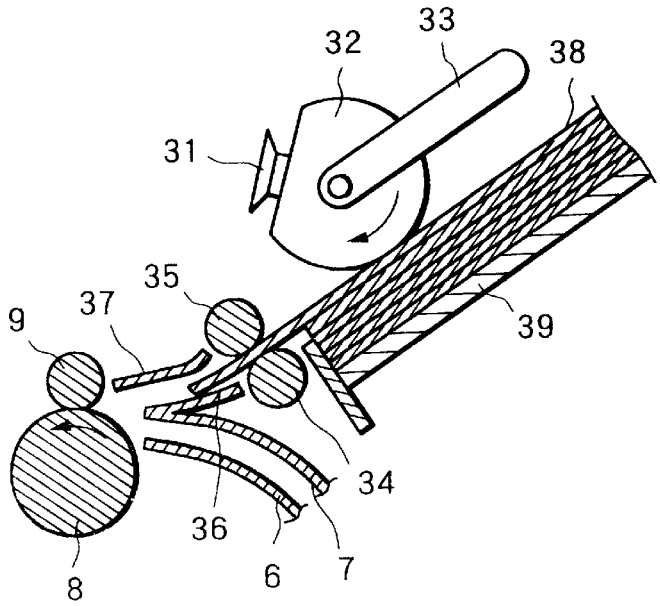
FIG. 9 is a diagram for describing the operation of a separating roller in a transport mechanism according to the second embodiment.
Figure 10:
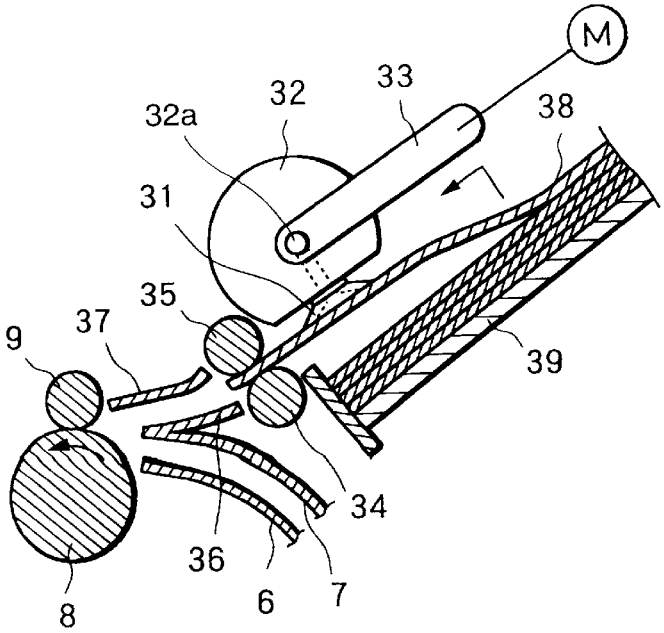
FIG. 10 is a diagram for describing the operation of a suction cup in a transport mechanism according to the second embodiment.

FIGS. 9 and 10 are diagrams useful in describing the operation of the second separating mechanism.

FIG. 9 illustrates the separation of plain paper, which is a recording medium having high air-permeability in which adjacent sheets exhibit little adhesion. In this case, the pressure plate 39 is moved upwards by a plunger and the like and presses the recording paper 38 against the separating roller 32, one sheet of the recording paper 38 is fed from the stack by rotation of the separating roller 32 by a well known separation theory and the sheet is grasped by the transport rollers 34, 35. When the suction cup 31 approaches the recording paper 38, the pressure plate 39 is lowered by deactivating the plunger so that the suction cup no longer contacts the recording paper. The above described operation is performed at every time of feeding a recording paper 38.

FIG. 10 illustrates the separation of recording paper (sheets) or the like. Here the recording paper 38 has an image-receiving layer provided on a base film of a material, such as PET, having low air-permeability as a result of which adjacent sheets exhibit a high adhesion. In this case, the suction cup 31 is made to approach the recording paper 38 and to contact the uppermost sheet thereof by moving downwards the support mechanism 33, after which air is withdrawn from the interior of the suction cup 31 so as to attract the uppermost sheet of the recording paper 38 by suction. The suction cup 31 is raised by moving upwards of the support mechanism 33 while attracting the uppermost sheet of recording paper 38, after which the suction cup 31 is moved toward the transport rollers 34, 35 by the support mechanism (including a little clockwise rotation of the roller 32) so that the leading edge of the sheet of recording paper 38 is inserted between the transport rollers 34, 35. This is the state depicted in FIG. 10. When the suction cup 31 releases its hold on the sheet of recording paper 38, the sheet of recording paper separates from the suction cup 31 and is fed by rotation of the transport rollers 34, 35. Other mechanisms and actions of the apparatus are similar to those of the first embodiment described above.

By adopting this arrangement, the second separating mechanism shown in FIGS. 9 and 10 is capable of selecting either feeding operation automatically and of supplying the sheets of recording paper 38 stably one sheet at a time in successive fashion regardless of whether the recording paper 38 is plain paper, which is a recording medium having high air-permeability in which adjacent sheets exhibit little adhesion, or a sheet having an image-receiving layer provided on a base film of a material, such as PET, having low air-permeability as a result of which adjacent sheets exhibit a high adhesion.

Further, an arrangement may be adopted in which, when the paper sensors 22, 24 sense that the first and second recording paper are of the same type and that the supply of recording paper from one of the recording paper accommodating units has been completed, control is carried out so as to change over to supply of recording paper from the other accommodating unit.

[Third Embodiment]

Figure 11:
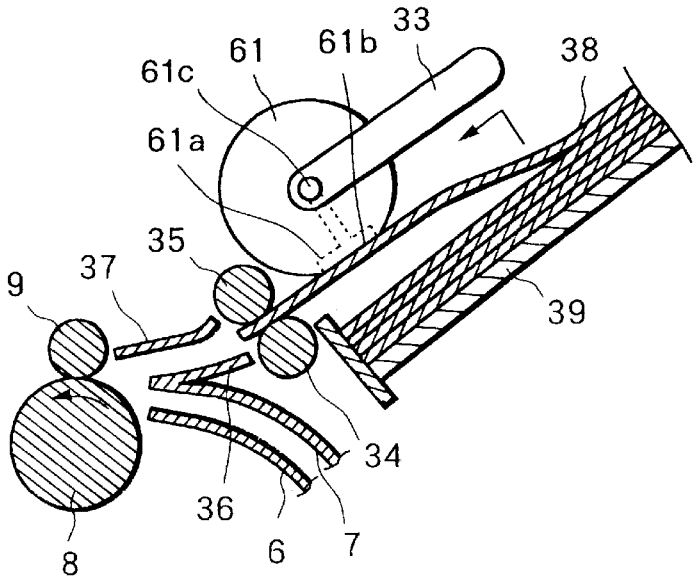
FIG. 11 is a diagram for describing a recording sheet separating mechanism in an ink-jet recording apparatus according to a third embodiment of the invention.

FIG. 11 is a diagram showing the construction of a sheet separating mechanism according to a third embodiment of the present invention, in which components identical with those shown in FIGS. 9 and 10 are designated by like reference characters and need not be described again.

As shown in FIG. 11, a separating roller 61 is integrally formed to have an internal suction passageway 61*a*. The suction passageway 61*a* forms a space that is exposed at a flat portion 61*b* on the outer periphery of the separating roller 61. The space is closed when a sheet of the recording paper 38 is attracted to the suction passageway 61*a*. The other end of the suction passageway 61*a* passes through the separating roller 61 and part of the rotary shaft 61*c* thereof and leads to a suction mechanism (FIG. 2). In the third embodiment, the pressure plate 39 may press the papers against the roller 61 while separating a sheet from the stack of papers by rotating the roller 61.

[Fourth Embodiment]

Figure 12:
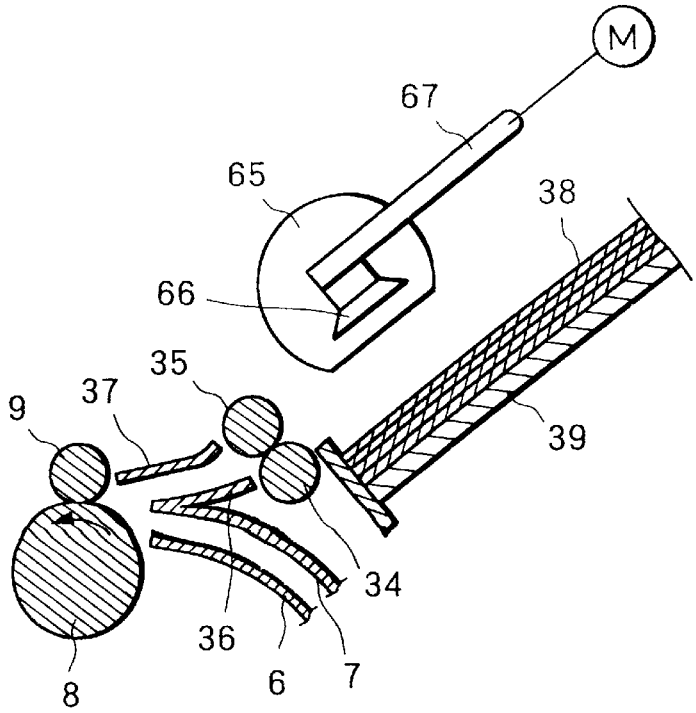
FIG. 12 is a diagram for describing a recording sheet separating mechanism in an ink-jet recording apparatus according to a fourth embodiment of the invention.

FIG. 12 is a diagram showing the construction of a sheet separating mechanism according to a fourth embodiment of the present invention, in which components identical with those shown in FIGS. 9 and 10 are designated by like reference characters and need not be described again.

According to the fourth embodiment, a separating roller 65, a suction cup 66 and a suction-cup support mechanism 67 are provided independently. In a case where the separating roller 65 is used, the suction cup 66 is secured at the position shown in FIG. 12 and the pressure plate 39 is moved upwards and presses the recording paper 38 against the separating roller 65. In a case where the suction cup 66 is used, the suction-cup support mechanism 67 is moved by a driving source M so as to lower the suction cup 66 into contact with the recording paper 38, attract the paper and move the suction cup 66 laterally.

Figure 13:
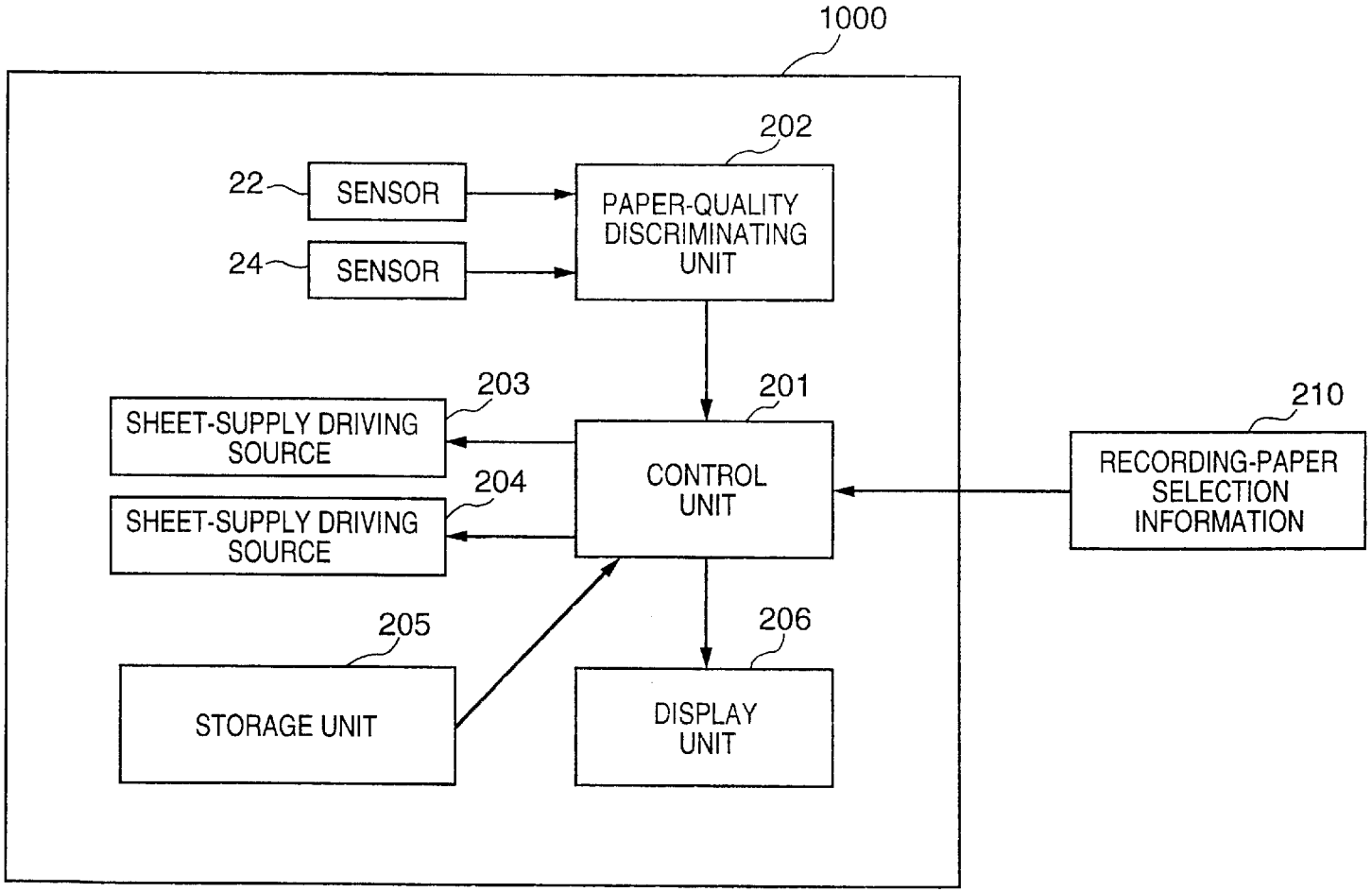
FIG. 13 is a functional block diagram illustrating the functions of the control circuitry of the ink-jet recording apparatus according to the first embodiment.

FIG. 13 is a block diagram showing an example of the control circuitry in an ink-jet recording apparatus 1000 according to the first embodiment.

In a case where a recording instruction that enters from a host device includes recording-paper selection information 210 in FIG. 13, the selection information is input to a control unit 201. The paper sensors 22, 24 obtain paper-quality information indicative of the quality of the first and second recording paper. On the basis of outputs from the sensors 22, 24, a paper-quality discriminating unit 202 discriminates the paper quality of the recording paper that has been placed in each of the accommodating units and sends the results to the control unit 201. The control unit 201 compares the entered results of paper quality discrimination and the recording-paper selection information 210. If the two agree, the control unit 201 sends a start signal to a sheet-supply driving source 203 or 204, which are for extracting the first and second recording paper, in such a manner that the desired recording paper is supplied. If the two disagree, this means that the recording paper is unsuitable, and, therefore a display to this effect is presented on a display unit 206 of a control panel or the like.

A storage unit 205 which stores the paper qualities capable of being handled by first and second sheet-supply drive mechanisms is provided. The control unit 201 compares the results of paper quality discrimination from the paper-quality discriminating unit 202 and the content of the storage unit 205. If the two do not match, the control unit 201 is capable of displaying a message to this effect on the display unit 206. It should be noted that an arrangement may be adopted in which the sensors 22, 24 are eliminated and the operator judges paper quality and inputs the relevant signal.

Figure 14:
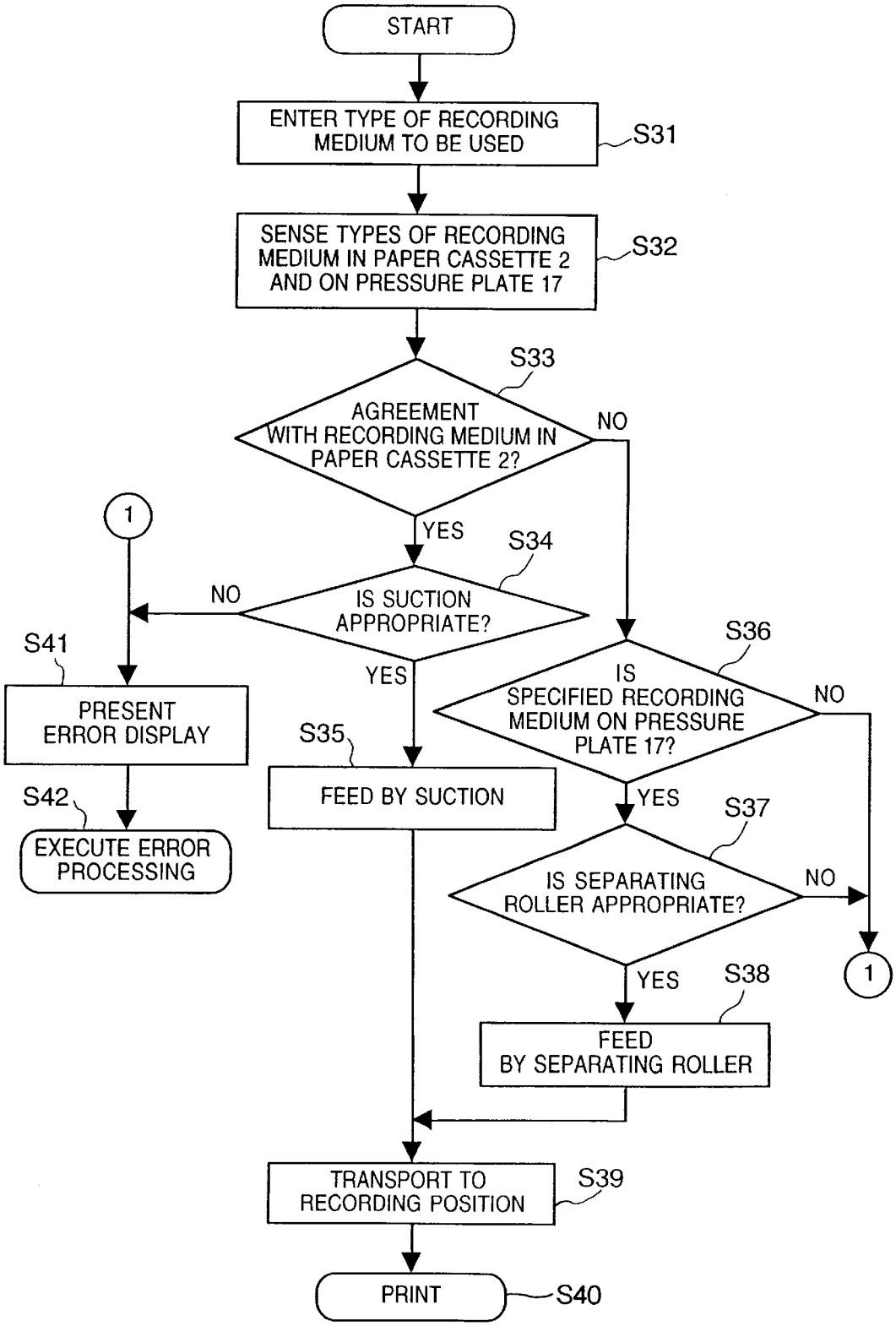
FIG. 14 is a flowchart illustrating recording processing in the ink-jet recording apparatus according to the first embodiment.

FIG. 14 is a flowchart illustrating recording processing according to this embodiment.

The recording-paper selection information 210 indicating the type of recording medium to be used in recording is entered from an external device at step S31. Control then proceeds to step S32, at which the type of recording medium accommodated in each accommodating unit is identified in accordance with the results of discrimination from the paper-quality discriminating unit 202 based upon the signals from the sensors 22, 24. This is followed by step S33, at which it is determined whether the recording medium of the type specified by the information 210 has been placed in the paper cassette 2. If the decision rendered is "YES", then control proceeds to step S34. Here it is determined whether the type of recording medium accommodated in the paper cassette 2 is suitable for feed by suction. If the answer is "YES", then control proceeds to step S35, at which the recording medium is attracted and fed using the suction cup 3. This is followed by step S39, at which the recording medium is transported by rotation of the transport rollers 4, 5, 8, 9 to the position at which recording is performed by the recording head 12. Recording is then carried out at step S40.

If it is found at step S34 that the type of recording medium is not suitable for feed by suction, then control proceeds to step S41, at which error information is displayed to instruct the operator to change the location at which the recording medium is accommodated. Error processing is then executed at step S42.

If it is found at step S33 that the recording medium of the type specified by the information 210 has not been placed in the paper cassette 2, then control proceeds to step S36. Here it is determined whether the recording medium of the type specified has been placed on the pressure plate 17. If the answer is "YES", control proceeds to step S37, where it is determined whether feeding by the separating roller is suitable for this recording medium. If it is suitable, then control proceeds to step S38, where the medium is separated and fed by the separating roller. This is followed by step S39. If feed by the separating roller is not suitable, then control proceeds from step S37 to step S41. Here, as described above, an error display is presented to instruct a change in the location at which this recording medium is accommodated.

Thus, in accordance with this embodiment, it is determined whether a recording medium of a specified type has been accommodated. If it has, then the recording medium is transported from the accommodating unit and recording is carried out. At this time it is determined whether the feed mechanism that feeds the recording medium from this accommodating portion is one that is suitable for this type of recording medium. Since the recording medium is fed and recorded on only if the feed mechanism is suitable, the recording medium will not be fed by the improper feed mechanism, thereby making it possible to eliminate difficulties during recording.

Figure 15:
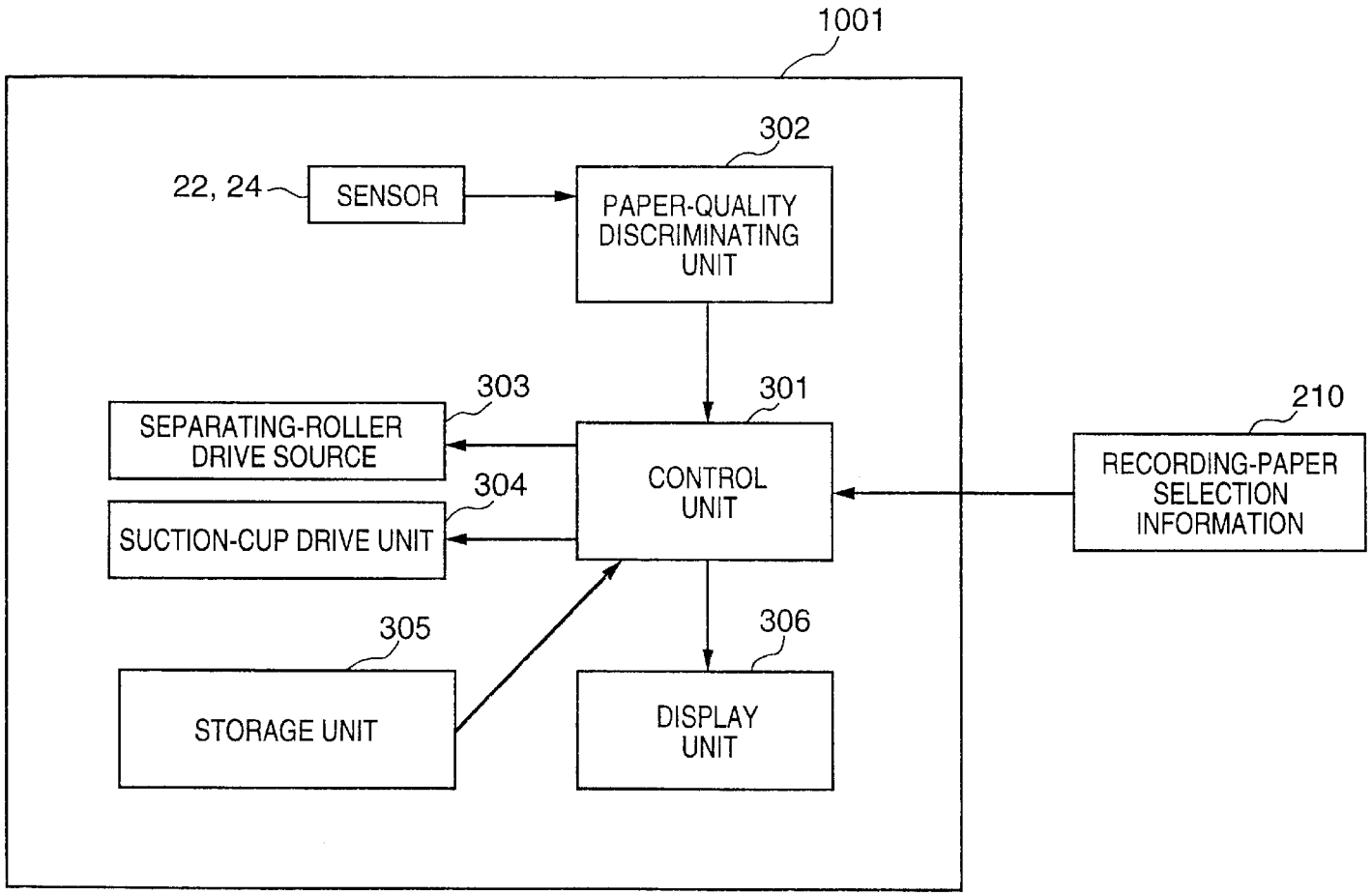
FIG. 15 is a functional block diagram illustrating the functions of the control circuitry of the ink-jet recording apparatus according to the second through fourth embodiments.

FIG. 15 is a diagram useful in describing an example of control in an ink-jet recording apparatus 1001 having two types of separating mechanisms, namely the suction cup 31 and the separating roller 32, for the same type of recording paper, as at the recording paper accommodating units of the second through fourth embodiments.

In a case where a recording instruction that enters from a host device includes recording-paper selection information 210 in FIG. 15, the selection information is input to a control unit 301. The paper sensors 22, 24 obtain paper-quality information indicative of the quality of the recording paper accommodated in the accommodating unit. On the basis of outputs from the sensors 22, 24, a paper-quality discriminating unit 302 discriminates the paper quality of the recording paper that has been placed in the accommodating unit and sends the results to the control unit 301. The control unit 301 compares the entered results of paper quality discrimination and the recording-paper selection information 210. If the two agree, the control unit 301 selects a drive unit (either 303 or 304) that is suited to the sensed paper quality, i.e., selects to drive the separating roller 32 or to separate the recording paper by using the suction cup 31, and sends a drive signal to the selected drive unit so that the desired recording paper will be supplied. If it is found that the results of paper quality discrimination input to the control unit 301 do not agree with recording-paper selection information 210, then a display indicating that the recording paper is not suitable is presented on a display unit 306.

A storage unit 305 which stores the paper qualities capable of being handled by the separating roller and suction cup mechanism is provided. The control unit 301 compares the results of paper quality discrimination from the paper-quality discriminating unit 302 and the content of the storage unit 305. If the two do not match, the control unit 301 is capable of displaying a message to this effect on the display unit 306. It should be noted that an arrangement may be adopted in which the sensors 22, 24 are eliminated and the operator judges paper quality and inputs the relevant signal.

Figure 16:
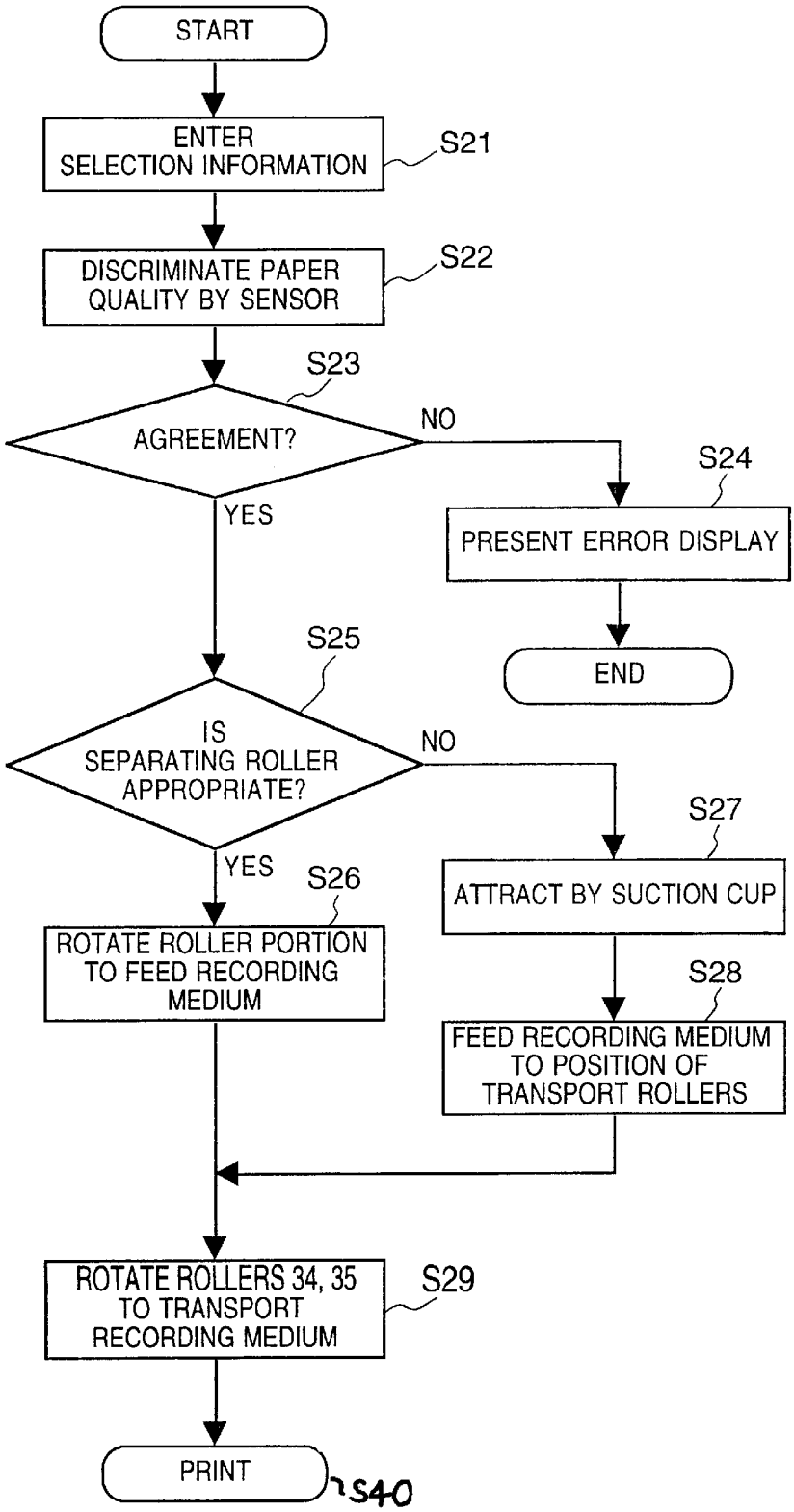
FIG. 16 is a flowchart illustrating processing in the ink-jet recording apparatus according to the second through fourth embodiments.

FIG. 16 is a flowchart illustrating processing in the arrangement of FIG. 15, for example, for a case where recording is performed upon selecting a recording paper that conforms to the recording-paper selection information 210 entered by the host device.

The selection information 210 is entered at step S21 and the type of recording paper accommodated in the accommodating unit is discriminated by the paper sensor 24 at step S22. It is determined at step S23 whether the sensed type of recording paper and the selection information 210 entered at step S21 agree. If the answer is "YES", then control proceeds to step S25, at which the recording-paper separating mechanism that conforms to the sensed type of recording paper is selected. If the decision rendered at step S23 is "NO", on the other hand, then control proceeds to step S24. Here a message to the effect that the desired recording is impossible is displayed on the display unit 306 or is set back to the host device as an error.

It is determined at step S25 whether the recording medium is one suitable for transport by the roller portion of the separating roller 32. If the answer is "YES", then control proceeds to step S26. Here the separating-roller drive unit 303 (FIG. 15), for example, is driven into operation to rotate the roller portion of the separating roller 32, thereby moving the recording medium 38 toward the recording position in the manner shown in FIG. 9. On the other hand, if it is determined a step S25 that the type of recording medium that has been placed on the pressure plate 17 is, say, a recording medium such as an OHP sheet that is not suitable for transport by the roller portion of the separating roller 32, then control proceeds to step S27 Here the suction-cup drive unit 304 (FIG. 15) is driven into operation so that the recording medium 38 is attracted, as shown for example in FIG. 10, using the suction cup 31 provided on the separating roller 32. Under these conditions the suction cup 31 is moved toward the transport rollers 34, 35 together with the separating roller 32 so that the recording medium 38 is grasped by the rollers 34, 35 (step S28). After the recording medium is transported to the position of the transport rollers 34, 35 by driving the selected mechanism, the transport rollers 34, 35 are rotated at step S29 to transport the recording medium to the recording position. The recording medium thus transported undergoes recording at step S27.

It should be noted that a recording medium conforming to the recording-paper selection information 210 entered by the host device can also be selected from either the pressure plate 17 or paper cassette 2 and recorded on through an arrangement obtained by combining the first embodiment and the second through fourth embodiments. In such case, when it is found at step S37 in the flowchart of FIG. 14 that transport by the separating roller is not appropriate, control would proceed to step S27 in FIG. 16 so that the recording medium would be attracted and transported by the suction cup 31. Further, when it is found at step S34 in FIG. 14 that transport by suction using the suction cup is not appropriate, then control would proceed to step S26 in FIG. 16 so that the recording medium would be transported by rotating the roller portion of the separating roller.

The present invention is not limited to the foregoing embodiments and can be modified in the following ways without departing from the scope of the claims:

(1) An arrangement may be adopted in which both separating mechanisms for the first and second recording paper are capable of jointly using two types of separating mechanisms which include the above-described separating roller and suction cup.

(2) The positions of the suction cup and separating roller are not limited to those of the foregoing embodiments; the separating roller may be placed at the first recording-paper accommodating unit (on the side of the paper cassette 2) and the suction cup at the second recording-paper accommodating unit (the pressure plate 17).

(3) The transport rollers 4, 5 may be dispensed with and the recording paper may be inserted between the sub-scan rollers 8, 9 directly by movement of the suction cup 3.

(4) A paper supply tray and a paper discharge tray may be tilted slightly from the horizontal in order to align the sheets of recording paper.

(5) The paper-quality sensing units need not rely upon light as in the foregoing embodiments. Other methods may be used to sense paper quality, such as by providing the recording paper with notches or with marks to be sensed.

The present invention provides outstanding effects with a recording head and recording apparatus of the ink-jet recording type, especially of the kind that utilizes thermal energy.

With regard to a typical configuration and operating principle, it is preferred that the foregoing be achieved using the basic techniques disclosed in the specifications of U.S. Pat. Nos. 4,723,129 and 4,740,796. This scheme is applicable to both so-called on-demand-type and continuous-type apparatuses. In the case of the on-demand type, at least one drive signal, which provides a sudden temperature rise that exceeds that for film boiling, is applied, in accordance with recording information, to an electrothermal transducer arranged to correspond to a sheet or fluid passageway holding a fluid (ink). As a result, thermal energy is produced in the electrothermal transducer to bring about film boiling on the thermal working surface of the ink-jet head. Accordingly, air bubbles can be formed in the fluid (ink) in one-to-one correspondence with the drive signals. Owing to growth and contraction of the air bubbles, the fluid (ink) is jetted via an orifice so as to form at least one droplet. If the drive signal has the form of a pulse, growth and contraction of the air bubbles can be made to take place rapidly and in appropriate fashion. This is preferred since it will be possible to achieve fluid (ink) discharge exhibiting excellent response.

Signals described in the specifications of U.S. Pat. Nos. 4,463,359 and 4,345,262 are suitable as drive pulses having this pulse shape. It should be noted that even better recording can be performed by employing the conditions described in the specification of U.S. Pat. No. 4,313,124, which discloses an invention relating to the rate of increase in the temperature of the above-mentioned thermal working surface.

In addition to the combination of the orifice, fluid passageway and electrothermal transducer (in which the fluid passageway is linear or right-angled) disclosed as the construction of the recording head in each of the abovementioned specifications, an arrangement using the art described in the specifications of U.S. Pat. Nos. 4,558,333 and 4,459,600, which disclose elements disposed in an area in which the thermal working portion is curved, may be employed. Further, it is possible to adopt an arrangement based upon Japanese Patent Application Laid-Open No. 59-123670, which discloses a configuration having a common slot for the ink discharge portions of a plurality of electrothermal transducers, or Japanese Patent Application Laid-Open No. 59-138461, which discloses a configuration having openings made to correspond to the ink discharge portions, wherein the openings absorb pressure waves of thermal energy.

As a recording head of the full-line type having a length corresponding to the maximum width of the recording medium capable of being recorded on by the recording apparatus, use can be made of an arrangement in which the length is satisfied by a combination of plural recording heads of the kind disclosed in the foregoing specifications, or an arrangement in which recording heads serve as a single integrally formed recording head.

The recording head may be of the replaceable tip-type, in which the connection to the apparatus and the supply of ink from the apparatus can be achieved by mounting the head on the apparatus, or of the cartridge type, in which the head itself is integrally provided with an ink tank.

In order to achieve the effects of the present invention more stably, it is preferred that the recording apparatus of the present invention be additionally provided with recovery means and preparatory auxiliary means for the recording head. Specific examples are recording head capping means, recording head cleaning means, recording head pressurizing or suction means, recording head preheating means comprising an electrothermal transducer, or a heating element separate from this transducer or a combination of the transducer and the heating element, and a preliminary discharge mode for performing a discharge of ink separate from a discharge for recording purposes. These expedients are effective in achieving stable recording.

The recording mode of the recording apparatus is not limited to a recording mode solely for the mainstream colors such as black and white. The apparatus adopted can be one equipped with at least one recording head for a plurality of different colors or one full-color recording head using mixed colors, through it is desired that this be achieved by a recording head having an integrated structure or by a combination of a plurality of recording heads.

Further, ink has been described as the fluid in the foregoing embodiments of the present invention. The ink used may be one which solidifies at room temperature or lower, one which softens at room temperature or one which is a liquid at room temperature. In general, temperature control is performed in such a manner that ink viscosity will fall within a stable ink jetting range by adjusting the temperature of the ink itself so as to fall within a temperature range of no less than 30° C. to no greater than 70° C. Accordingly, it will suffice to use an ink liquefied when the recording signal is applied.

In order to positively prevent elevated temperature due to thermal energy by using this as the energy for converting the ink from the solid state to the liquid state, or in order to prevent evaporation of the ink, it is permissible to use an ink which solidifies when left standing but which is liquefied by application of heat. In any case, ink which is liquefied for the first time by thermal energy, such as an ink liquefied by application of thermal energy conforming to a recording signal and jetted as a liquid ink, or ink which has already begun to solidify at the moment it reaches the recording medium, can be applied to the present invention. Such inks may be used in a form in which they oppose the electrothermal transducer in a state in which they are held as a liquid or solid in the recesses or through-holes of a porous sheet, as described in Japanese Patent Application Laid-Open Nos. 54-56847 and 60-71260. In the present invention, the most effective method of dealing with these inks is the above-described method of film boiling.

The recording apparatus of the present invention may take on the form of an apparatus that is an integral part of or separate from an image output terminal of information processing equipment such as a computer, a copier in combination with a reader or the like, or a facsimile machine having a transmitting/receiving function.

The present invention can be applied to a system constituted by a plurality of devices (e.g., a host computer, interface, reader, printer, etc.) or to an apparatus comprising a single device (e.g., a copier or facsimile machine, etc.).

Further, it goes without saying that the object of the present invention can also be achieved by providing a storage medium storing the program codes of the software for performing the aforesaid functions of the foregoing embodiments to a system or an apparatus, reading the program codes with a computer (e.g., a CPU or MPU) of the system or apparatus from the storage medium, and then executing the program.

In this case, the program codes read from the storage medium implement the novel functions of the invention, and the storage medium storing the program codes constitutes the invention.

Further, the storage medium, such as a floppy disk, hard disk, optical disk, magneto-optical disk, CD-ROM, CD-R, magnetic tape, non-volatile type memory card or ROM can be used to provide the program codes.

Furthermore, besides the case where the aforesaid functions according to the embodiments are implemented by executing the program codes read by a computer, the present invention covers a case where an operating system or the like working on the computer performs a part of or the entire process in accordance with the designation of program codes and implements the functions according to the embodiment.

The present invention further covers a case where, after the program codes read from the storage medium are written in a function extension board inserted into the computer or in a memory provided in a function extension unit connected to the computer, a CPU or the like contained in the function extension board or function extension unit performs a part of or the entire process in accordance with the designation of program codes and implements the function of the above embodiments.

The effects of the embodiments of the present invention will now be set forth.

Two types of recording paper can be selected automatically and fed reliably one sheet at a time without sacrificing compactness and without inserting the two types of recording paper manually sheet by sheet.

It is possible to feed, stably and in succession, even recording paper having a large, smooth surface area and a high degree of adhesion with regard to adjacent sheets.

(a) Effects obtained when the apparatus has a tray, on which sheets of recording paper that have undergone recording are placed, arranged substantially in parallel with a recording-paper accommodating unit downstream of a sub-scan unit in terms of the transport direction:

The recording paper that has undergone recording can be placed on the tray without requiring any increase in the area needed to install the apparatus. The recording paper that has undergoing recording can be discharged at a position easily accessible by the operator, and it is easy to stack and accommodate the recording paper.

(b) Effects obtained when different types of recording paper are loaded in first and second recording-paper accommodating units and either type of recording paper is selected and supplied based upon paper-type selection information included in a recording instruction applied to the apparatus:

Stable, malfunction-free recording can be performed efficiently with minimal operator labor. This eliminates wasting of paper due to recording mistakes.

(c) Effects obtained when the apparatus has means for sensing the type of recording paper loaded in a recording-paper accommodating unit:

Stable, malfunction-free recording can be performed efficiently with minimal operator labor. This eliminates wasting of paper due to recording mistakes.

(d) Effects obtained when the apparatus has means for identifying the types of first and second recording paper automatically or in response to an input from the operator, comparing the sensed type with paper-type selection information included in an entered recording instruction and, if the installed recording paper does not match the instruction, displaying a message to this effect, Wasting of paper due to recording mistakes is eliminated.

(e) Effects obtained when the apparatus has means for identifying the types of first and second recording paper automatically or in response to an input from the operator, determining whether installed recording paper is of a type capable of being supplied by first and second recording-paper supply means and, if the recording paper is not suitable for supply by these supply means, displaying a message to this effect:

It is possible to prevent the accidental loading of recording paper that cannot be handled by a separating mechanism and, hence, the occurrence of trouble such as problems in transporting recording paper. As a result, it is possible to eliminate wasting of recording paper as caused by jamming of the paper due to problems in transporting the same.

(f) Effects obtained when the supply of one type of recording paper starts automatically after supply of the other type of recording paper ends:

Recording can be carried out efficiently without any interruption in the recording operation even in a case where a plurality of recording instructions arrive successively.

The present invention is not limited to the above embodiments and various changes and modifications can be made within the spirit and scope of the present invention. Therefore, to apprise the public of the scope of the present invention, the following claims are made.

What is claimed is:

1. A recording apparatus for transporting a recording medium and recording an image on the recording medium by a recording means, comprising:

first accommodating means capable of stacking and accommodating a plurality of sheets of a recording medium;

second accommodating means capable of stacking and accommodating a plurality of sheets of a recording medium;

suction separating means for suctioning and separating a sheet of the recording medium, which is accommodated in said first accommodating means, by a suction unit and feeding the sheet;

separation feeding means for separating a sheet of the recording medium, from the sheets of the recording medium that are accommodated in said second accommodating means, by a separation roller and feeding the sheet; and first and second sensing means for sensing types of recording media accommodated in said first and second accommodating means, respectively.

2. A recording apparatus for transporting a recording medium and recording an image on the recording medium by a recording means, comprising:

first accommodating means capable of stacking and accommodating a plurality of sheets of a recording medium;

second accommodating means capable of stacking and accommodating a plurality of sheets of a recording medium;

suction separating means for suctioning and separating a sheet of the recording medium, which is accommodated in said first accommodating means, by a suction unit and feeding the sheet; and separation feeding means for separating a sheet of the recording medium, from the sheets of the recording medium that are accommodated in said second accommodating means, by a separation roller and feeding the sheet, wherein said separation feeding means is capable of selectively executing separation and feeding by said separating roller, or separation and feeding by suction using a suction unit, of a sheet of the recording medium that is accommodated in said second accommodating means.

3. A recording apparatus for transporting a recording medium and recording an image on the recording medium by a recording means, comprising:

an accommodating unit capable of stacking and accommodating a plurality of sheets of a recording medium;

discriminating means for discriminating types of recording media accommodated in said accommodating unit;

suction separating means for suctioning a sheet of the recording medium, which is accommodated in said accommodating unit, by a suction unit and feeding the sheet;

separation transporting means for separating a sheet of the recording medium, from the sheets of the recording media which are accommodated in said accommodating unit, by a separation roller and feeding the sheet;

input means for inputting specifying information which specifies the type of recording medium to be used in recording; and control means for determining whether the specified type of recording medium is accommodated in said accommodating unit, and, when it is determined that the specified type of recording medium is accommodated in said accommodating unit, for determining whether said suction separating means or said separation transporting means corresponds to the specified type of recording medium, and performing control to feed the specified type of recording medium by said suction separating means or said separation transporting means.

4. A recording apparatus for transporting a recording medium and recording an image on the recording medium by a recording means, comprising:

a first accommodating unit capable of stacking and accommodating a plurality of sheets of a recording medium;

a second accommodating unit capable of stacking and accommodating a plurality of sheets of a recording medium;

discriminating means for discriminating types of recording media accommodated in said first and second accommodating units;

suction separating means for suctioning a sheet of the recording medium, which has been accommodated in said first accommodating unit, by a suction unit and feeding the sheet;

separation transporting means for separating a sheet of the recording medium, from the sheets of the recording medium which have been accommodated in said second accommodating unit, by a separation roller and feeding the sheet;

input means for inputting, from an external device, specifying information which specifies the type of recording medium to be used in recording; and control means for determining whether the specified type of recording medium is accommodated in said first or second accommodating unit, and, when it is determined that the specified type of recording medium is accommodated in said first or second accommodating unit, for determining whether said suction separating means or said separation transportation means corresponds to the specified type of recording medium, for performing control to feed the specified type of recording medium by said suction separating means or said separation transporting means.

5. An apparatus for transporting a medium, comprising:

first accommodating means capable of stacking and accommodating a plurality of sheets of a medium;

second accommodating means capable of stacking and accommodating a plurality of sheets of a medium;

suction separating means for suctioning and separating a sheet of the medium, which is accommodated in said first accommodating means, by a suction unit and feeding the sheet;

separation feeding means for separating a sheet of the medium, from the sheets of the medium which are accommodated in said second accommodating means, by a separation roller and feeding the sheet; and first and second sensing means for sensing types of media accommodated in said first and second accommodating means, respectively.

6. An apparatus for transporting a medium, comprising:

first accommodating means capable of stacking and accommodating a plurality of sheets of a medium;

second accommodating means capable of stacking and accommodating a plurality of sheets of a medium;

suction separating means for suctioning and separating a sheet of the medium, which is accommodated in said first accommodating means, by a suction unit and feeding the sheet; and separation feeding means for separating a sheet of the medium, from the sheets of the medium which are accommodated in said second accommodating means, by a separation roller and feeding the sheet.

wherein said separation feeding means is capable of selectively executing separation and feeding by said separating roller, or separation and feeding by suction using a suction unit, of a sheet of the medium that is accommodated in said second accommodating means.

7. An apparatus for transporting a medium, comprising:

a first accommodating unit capable of stacking and accommodating a plurality of sheets of a medium;

second accommodating unit capable of stacking and accommodating a plurality of sheets of a medium;

discriminating means for discriminating types of media accommodated in said first and second accommodating units;

suction separating means for suctioning a sheet of the medium, which is accommodated in said first accommodating unit, by a suction unit and feeding the sheet;

separation transporting means for separating a sheet of the medium, from the sheets of the medium which are accommodated in said second accommodating unit, by a separation roller and feeding the sheet;

input means for inputting, from an external device, specifying information which specifies the type of medium; and control means for determining whether the specified type of recording medium is accommodated in said first or second accommodating unit, and, when it is determined that the specified type of medium is accommodated in said first or second accommodating unit, for determining whether said suction separating means or said separation transporting means corresponds to the specified type of medium, and for performing control to feed the specified type of medium by said suction separating means or said separation transporting means.

8. An apparatus for transporting a medium, comprising:

an accommodating unit capable of stacking and accommodating a plurality of sheets of a medium;

discriminating means for discriminating types of media accommodated in said accommodating unit;

suction separating means for suctioning a sheet of the medium, which is accommodated in said accommodating unit, by a suction unit and feeding the sheet;

separation transporting means for separating a sheet of the medium, from the sheets of the medium which are accommodated in said accommodating unit, by a separation roller and feeding the sheet;

input means for inputting specifying information which specifies the type of medium; and control means for determining whether the specified type of medium is accommodated in said accommodating unit, and, when it is determined that the specified type of medium is accommodated in said accommodating unit, for determining whether said suction separating means or said separation transporting means corresponds to the specified type of medium, and performing control to feed the specified type of medium by said suction separating means or said separation transporting means.

9. A recording apparatus for transporting a recording medium and recording an image on the recording medium by a recording means, comprising:

first accommodating means capable of stacking and accommodating a plurality of sheets of a recording medium;

second accommodating means capable of stacking and accommodating a plurality of sheets of a recording medium;

suction separating means for suctioning and separating a sheet of the recording medium, which is accommodated in said first accommodating means, by a suction unit and feeding the sheet;

separation feeding means for separating a sheet of the recording medium, from the sheets of the recording medium that are accommodated in said second accommodating means, by a separation roller and feeding the sheet; and input means for inputting, from an external device, specifying information which specifies the type of recording medium to be used in recording;

determination means for determining whether the specified type of recording medium is accommodated in said first or second accommodating means; and recording control means which, on the basis of the determination made by said determination means, extracts a sheet of the specified type of recording medium from said first or second accommodating means and causes recording to be performed on the extracted recording medium.

10. The apparatus according to claim 9, further comprising output means which, when said determination means determines that the specified type of recording medium is not accommodated in either of said first and second accommodating means, displays this fact or outputs a signal indicative thereof.

11. An apparatus for transporting a medium, comprising:

first accommodating means capable of stacking and accommodating a plurality of sheets of a medium;

second accommodating means capable of stacking and accommodating a plurality of sheets of a medium;

suction separating means for suctioning, and separating a sheet of the medium, which is accommodated in said first accommodating means, by a suction unit and feeding the sheet;

separation feeding means for separating a sheet of the medium, from the sheets of the medium which are accommodated in said second accommodating means, by a separation roller and feeding the sheet;

input means for inputting, from an external device, specifying information which specifies a type of medium;

determination means for determining whether the specified type of medium is accommodated in said first or second accommodating means; and control means which, on the basis of the determination made by said determination means, extracts a sheet of the specified type of medium from said first or second accommodating means.

12. The apparatus according to claim 11, further comprising output means which, when said determination means determines that the specified type of medium is not accommodated in either of said first and second accommodating means, displays this fact or outputs a signal indicative thereof.

13. A recording apparatus for transporting a recording medium and recording an image on the recording medium by a recording means, comprising:

first accommodating means capable of stacking and accommodating a plurality of sheets of a recording medium;

second accommodating means capable of stacking and accommodating a plurality of sheets of a recording medium;

discriminating means for discriminating types of recording media accommodated in said first and second accommodating means;

first feed means for feeding a sheet of the recording medium, which has been accommodated in said first accommodating means, by a suction unit or separating roller;

second feed means for feeding a sheet of the recording medium, which has been accommodated in said second accommodating means, by a suction unit or separating roller;

input means for inputting, from an external device, specifying information which specifies the type of recording medium to be used in recording; and control means for determining whether the specified type of recording medium has been discriminated by said discriminating means, and, when it is determined that the specified type of recording medium is accommodated in either of said first or second accommodating means, for performing control in dependence upon the specified type of recording medium in such a manner that the specified type of recording medium is fed by the suction unit or separating roller of the corresponding first or second feed means.

14. The apparatus according to claim 13, further comprising transport means for transporting recording media, which have been fed from said first and second accommodating means, to a position at which recording is performed by the recording means.

15. The apparatus according to claim 13, further comprising output means which, when said control means determines that the specified tape of recording medium is not accommodated in either said first or second accommodating means, displays this fact or outputs a signal indicative thereof.

16. The apparatus according to claim 13, wherein said recording apparatus comprises an ink-jet recording apparatus.

17. The apparatus according to claim 16, wherein said ink-jet recording apparatus comprises a recording head for jetting ink by utilizing thermal energy, said recording head comprising a thermal energy transducer for generating the thermal energy applied to the ink.

18. A recording apparatus for transporting recording media and recording images on the recording media by a recording means, comprising:

accommodating means for accommodating the recording media; and separate feeding means for picking up the recording media one by one from said accommodating means and feeding each recording medium, wherein said separate feeding means comprises:

a suction separating unit for separating a recording medium by a suction unit and feeding the recording medium; and a separate feeding rotary unit for separating a recording medium by a separation roller and feeding the recording medium, wherein said separate feeding means selects either said suction separating unit or said separate feeding rotary unit for picking a the recording medium.

19. The apparatus according to claim 18, wherein said separation roller comprises a roller and feeds the recording medium by rotation of the roller, and wherein the suction separating unit is disposed in the roller and a suction port is provided in a portion of a circumference of the roller.

20. The apparatus according to claim 18, wherein said separation roller comprises a roller and feeds a recording medium by rotation of the roller, and wherein a suction cup of said suction separating unit is disposed along an axis of the roller and rocks independently on the roller.

21. The apparatus according to claim 18, wherein said separation roller has a cut portion in a circumference of the roller, and a recording medium is fed by contact with a remaining portion of the circumference, and wherein said suction separating unit is disposed being protruded from the cut portion.

22. The apparatus according to claim 21, wherein the recording medium is pressed against said separation roller when said separation roller separates and feeds a recording medium, and wherein said suction unit is moved downwards to the recording medium and is moved upwards when the recording medium is fed by said suction separating unit.

23. The apparatus according to claim 22, further comprising an arm capable of rocking for supporting the roller.

24. An apparatus for transporting a medium, comprising:

first accommodating means capable of stacking and accommodating a plurality of sheets of a medium;

second accommodating means capable of stacking and accommodating a plurality of sheets of a medium;

discriminating means for discriminating types of media accommodated in said first and second accommodating means;

first feed means for feeding a sheet of the medium, which has been accommodated in said first accommodating means, by a suction unit or separating roller;

second feed means for feeding a sheet of the medium, which has been accommodated in said second accommodating means, by a suction unit or separating roller;

input means for inputting, from an external device, specifying information which specifies the type of medium; and control means for determining whether the specified type of medium has been discriminated by said discriminating means, and when it is determined that the specified type of medium is accommodated in said first or second accommodating means, for performing control in dependence upon the specified type of recording medium in such a manner that the specified type of medium is fed by the suction unit or separating roller of the corresponding first or second feed means.

25. The apparatus according to claim 24, further comprising transport means for transporting media, which have been fed from said first and second accommodating means.

26. The apparatus according to claim 24, further comprising output means which, when said control means determines that the specified type of medium is not accommodated in either of said first and second accommodating means, displays this fact or outputs a signal indicative thereof.

27. The apparatus according to claim 24, wherein said apparatus comprises an ink-jet recording apparatus.

28. The apparatus according to claim 27, wherein said ink-jet recording apparatus further comprises a recording head for jetting ink by utilizing thermal energy, said recording head comprising a thermal energy transducer for generating the thermal energy applied to the ink.

29. An apparatus for transporting a medium, comprising:

accommodating means for accommodating the medium; and separate feeding means for picking up a medium one by one from the accommodating means and feeding the medium, wherein said separate feeding means comprises:

a suction separating unit for separating a medium by a suction unit and feeding the medium; and a separate feeding rotary unit for separating a medium by a separation roller and feeding the medium, wherein said separate feeding means selects either said suction separating unit or said separate feeding rotary unit for picking up and feeding the medium.

30. The apparatus according to claim 29, wherein said separation roller comprises a roller and feeds the medium by rotation of the roller, and wherein said suction separating unit is disposed in the roller and a suction port is provided in a portion of a circumference of the roller.

31. The apparatus according to claim 29, wherein said separation roller comprises a roller and feeds a medium by rotation of the roller, and wherein a suction cup of said suction separating unit is disposed along an axis of the roller and rocks independently on the roller.

32. The apparatus according to claim 29, wherein said separation roller has a cut portion in a circumference of the roller, and a medium is fed by contact with a remaining portion of the circumference, and wherein said suction separating unit is disposed being protruded from the cut portion.

33. The apparatus according to claim 32, wherein the medium is pressed against said separation roller when said separation roller separates and feeds a medium, and wherein said suction unit is moved downwards to the medium and is moved upwards when the medium is fed by said suction separating unit.

34. The apparatus according to claim 33, further comprising an arm capable of rocking for supporting the roller.

* * * * *